US009257074B2

(12) United States Patent
Tseng

(10) Patent No.: US 9,257,074 B2
(45) Date of Patent: Feb. 9, 2016

(54) PIXEL COMPENSATION CIRCUIT

(71) Applicant: AU OPTRONICS CORP., Hsin-Chu (TW)

(72) Inventor: Ching-Chieh Tseng, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 0 days.

(21) Appl. No.: 14/445,404

(22) Filed: Jul. 29, 2014

(65) Prior Publication Data

US 2015/0317931 A1 Nov. 5, 2015

(30) Foreign Application Priority Data

May 5, 2014 (TW) ..... 103115997 A

(51) Int. Cl.
*G09G 1/00* (2006.01)
*G09G 3/32* (2006.01)

(52) U.S. Cl.
CPC ..... *G09G 3/3258* (2013.01); *G09G 2300/0814* (2013.01); *G09G 2300/0819* (2013.01); *G09G 2320/0209* (2013.01); *G09G 2320/0233* (2013.01); *G09G 2320/045* (2013.01)

(58) Field of Classification Search
CPC ..... G09G 1/00; G09G 3/3233; G09G 2300/0819; G09G 2300/0842; G09G 2300/0861; G09G 2300/043
See application file for complete search history.

(56) References Cited

U.S. PATENT DOCUMENTS

2005/0259051 A1 11/2005 Lee et al.
2014/0125414 A1* 5/2014 Chen ..... 330/261
2014/0225878 A1* 8/2014 Shih ..... G09G 3/3258 345/205

FOREIGN PATENT DOCUMENTS

CN 1734532 2/2006
CN 104867442 8/2015
TW 201137825 11/2011

OTHER PUBLICATIONS

China Patent Office, "Office Action," Nov. 2, 2015.

* cited by examiner

*Primary Examiner* — Michael Faragalla
(74) *Attorney, Agent, or Firm* — WPAT, PC; Justin King

(57) ABSTRACT

A pixel compensation circuit includes a first transistor, a second transistor, a third transistor, a fourth transistor, a fifth transistor, a switch unit and a light emitting diode. The first transistor, the third transistor, the fourth transistor, the fifth transistor, and the switch unit are used to receive a respective switch signal. The pixel compensation circuit can compensate a threshold voltage of transistor automatically; and consequentially a driving current of light emitting diode is prevented from being affected by the change of the threshold voltage or the voltage drop of the light emitting diode.

13 Claims, 4 Drawing Sheets

PIXEL COMPENSATION CIRCUIT

TECHNICAL FIELD

The present disclosure relates to a pixel compensation circuit, and more particularly to a pixel compensation circuit for compensating the threshold voltage and driving current.

BACKGROUND

Active matrix organic light emitting diode (AMOLED) display has some advantages such as compact size, high efficiency and high color saturation, so that AMOLED has become one of the mainstreams in the display technology. However, because the manufacturing variation or the threshold voltage variation resulted from the aging degradation of transistors, the driving current as well as the crossing voltage of the light emitting diode may be unstable and the consequentially the associated AMOLED display panel may have brightness non-uniformity issue. In addition, the AMOLED is driven by current, poor display quality may also happen when the gate-source crossing voltage of transistor is affected by the increase of the internal resistance of the AMOLED.

SUMMARY

The present disclosure provides a pixel compensation circuit, which includes a first transistor, a second transistor, a third transistor, a fourth transistor, a fifth transistor, a switch unit and a light emitting diode. The first transistor is configured to have a gate terminal thereof for receiving a respective switch signal and a first terminal thereof for receiving a high voltage. The second transistor is configured to have a first terminal thereof electrically connected to a second terminal of the first transistor. The third transistor is configured to have a gate terminal thereof for receiving a respective switch signal, a first terminal thereof for receiving a data signal, and a second terminal thereof electrically connected to a second terminal of the second transistor. The fourth transistor is configured to have a gate terminal thereof for receiving a respective switch signal, a first terminal thereof electrically connected to a second terminal of the first transistor, and the first terminal of the second transistor, and a second terminal thereof electrically connected to the gate terminal of the second transistor and a first terminal of a capacitor. The fifth transistor is configured to have a gate terminal thereof for receiving a respective switch signal, a first terminal thereof electrically connected to a second terminal of the capacitor, and a second terminal thereof for receiving a reference voltage. The switch unit is configured to receive a respective switch signal and electrically connected to the second terminal of the third transistor, the first terminal of the fifth transistor, and the second terminal of the capacitor. The light emitting diode is configured to have a first terminal thereof electrically connected to the switch unit and a second terminal thereof for receiving the low voltage.

In summary, through employing a switch circuit, the pixel compensation circuit of the present disclosure can automatically compensate the threshold voltage in advance according to the received switch signal. Consequentially, the driving current flowing through the light emitting diode will not be changed with the voltage drop thereof; and as a result, the non-uniformity or other related poor displaying issues are avoided.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
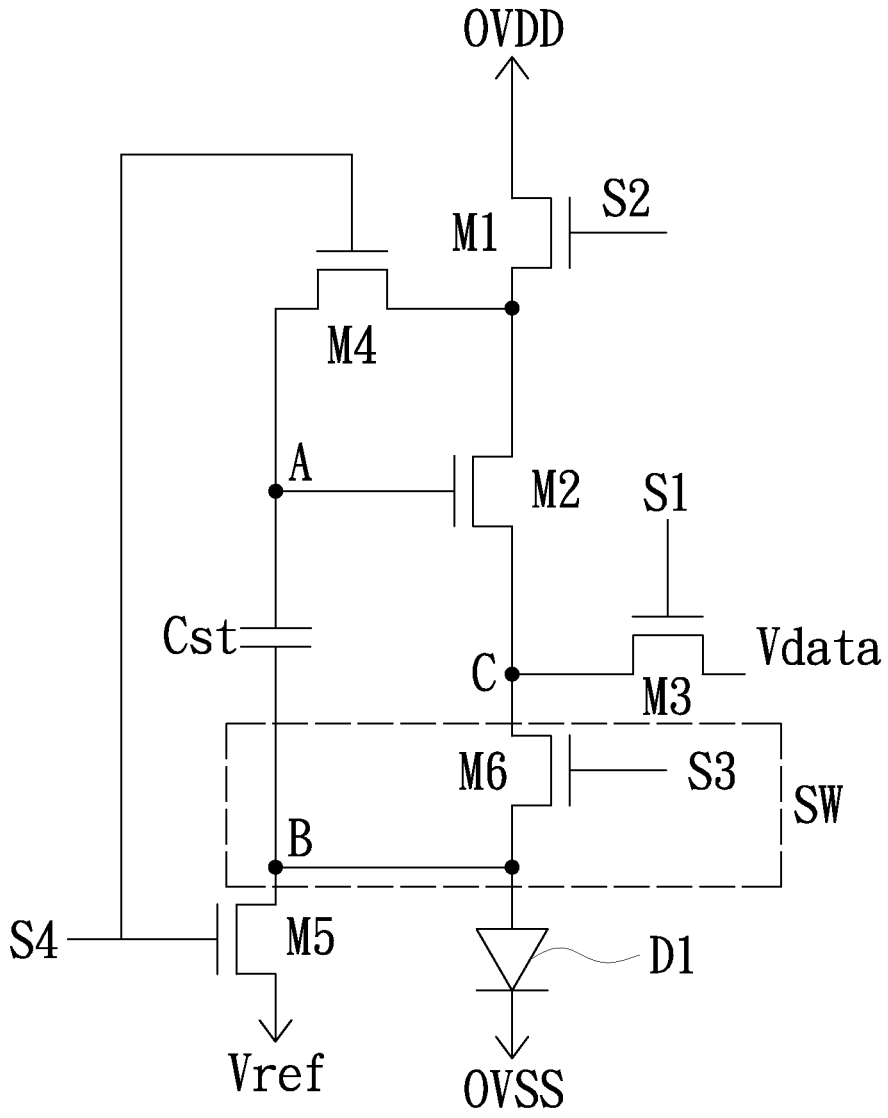
FIG. 1 is a schematic view of a pixel compensation circuit in accordance with a first embodiment of the present disclosure.

FIG. 1 is a schematic view of a pixel compensation circuit in accordance with a first embodiment of the present disclosure. As shown, the pixel compensation circuit in the present embodiment includes a first transistor M1, a second transistor M2, a third transistor M3, a fourth transistor M4, a fifth transistor M5, a switch unit SW, a light emitting diode D1 and a capacitor Cst. In one embodiment, the first transistor M1, the second transistor M2, the third transistor M3, the fourth transistor M4 and the fifth transistor M5 may be implemented with N-type transistors. The first transistor M1, the third transistor M3, the fourth transistor M4, the fifth transistor M5 and the switch unit SW are configured to be turned on or turned off according to a received switch signal thereby forming a loop; wherein the aforementioned switch signal may include a first switch signal S1, a second switch signal S2, a third switch signal S3 and a fourth switch signal S4.

The first transistor M1 is configured to have its gate terminal for receiving the second switch signal S2; its first terminal for receiving a high voltage OVDD; and its second terminal electrically connected to the first terminal of the second transistor M2 and the first terminal of the fourth transistor M4. The second transistor M2 is, for example, a driving transistor and configured to have its gate terminal electrically connected to the second terminal of the fourth transistor M4 and the first terminal of the capacitor Cst; its first terminal electrically connected to the second terminal of the first transistor M1 and the first terminal of the fourth transistor M4; and its second terminal electrically connected to the second terminal of the third transistor M3 and the switch unit SW. The third transistor M3 is configured to have its gate terminal for receiving the first switch signal is S1; its first terminal for receiving a data signal Vdata; and its second terminal electrically connected to the second terminal of the second transistor M2 and the switch unit SW. The aforementioned data signal Vdata is for controlling the light brightness of the light emitting diode D1.

The fourth transistor M4 is configured to have its gate terminal for receiving the fourth switch signal S4; its first terminal electrically connected to the second terminal of the first transistor M1 and the first terminal of the second transistor M2; and its second terminal electrically connected to the gate terminal of the second transistor M2 and the first terminal of the capacitor Cst. The fifth transistor M5 is configured to have its gate terminal for receiving the fourth switch signal S4; its first terminal electrically connected to the second terminal of the capacitor Cst and the switch unit SW; and its second terminal for receiving a reference voltage Vref. The light emitting diode D1 is configured to have its first terminal electrically connected the switch unit SW; and its second terminal for receiving a low voltage OVSS. Specifically, the light emitting diode D1 is configured to determine its light brightness according to a driving current flowing from its first terminal to its second terminal (that is, the current Ids flowing from the drain terminal to the source terminal of the second transistor M2).

The switch unit SW may further include a sixth transistor M6. The sixth transistor M6 may be implemented with an N-type transistor and is configure to have its gate terminal for receiving the third switch signal S3; its first terminal electrically connected to the second terminal of the third transistor M3 and the second terminal of the second transistor M2; and its second terminal electrically connected to the first terminal of the light emitting diode D1, the first terminal of the fifth transistor M5 and the second terminal of the capacitor Cst.

Figure 2:
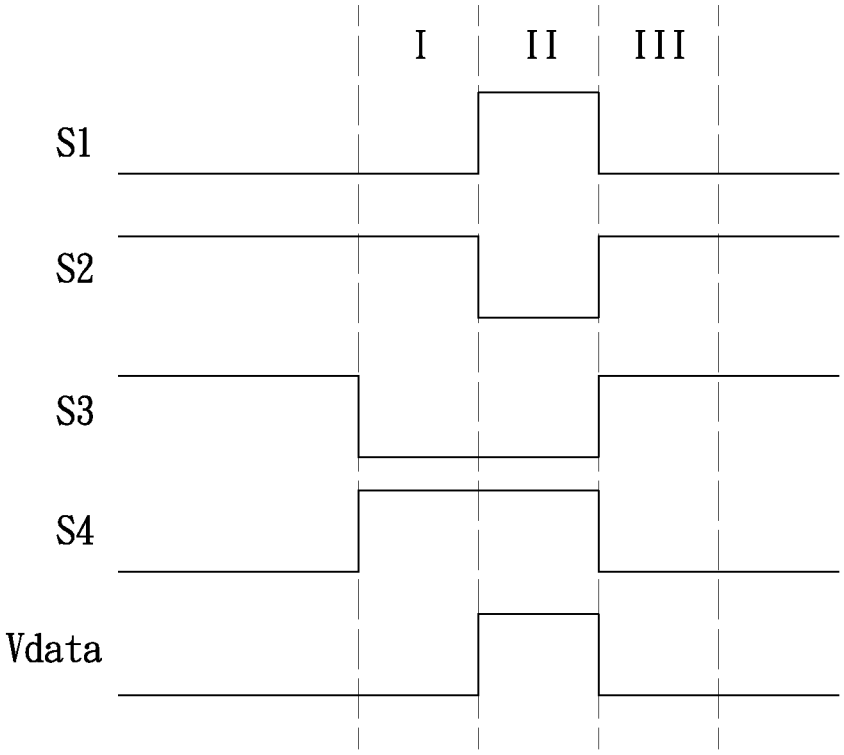
FIG. 2 is a timing diagram of the signals associated with the pixel compensation circuit shown in FIG. 1.

FIG. 2 is a timing diagram of the switch signal S1, the second switch signal S2, the third switching signal S3, the fourth switch signal S4 and the data signal Vdata in accordance with the first embodiment of the present disclosure. As shown, the timing diagram is exemplified to have three successive periods I, II and III. As shown, the first switch signal S1 and the data signal Vdata have the same timing sequence; that is, both of the first switch signal S1 and the data signal Vdata have high-voltage level in one same period and both of the first switch signal S1 and the data signal Vdata have low-voltage level in another one same period. The first switch signal S1 and the second switch signal S2 have the opposite timing sequence; that is, the first switch signal S1 has a high-voltage level while the second switch signal S2 has a low-voltage level and the first switch signal S1 has a low-voltage level while the second switch signal S2 has a high-voltage level. The third switch signal S3 and the fourth switch signal S4 have the opposite timing sequence; that is, the third switch signal S3 has a high-voltage level while the fourth switch signal S4 has a low-voltage level and the third switch signal S3 has a low-voltage level while the fourth switch signal S4 has a high-voltage level.

The operation of the pixel compensation circuit in the present embodiment will be described in detail as follow with a reference of FIGS. 1, 2. First, in the period I (also referred to as a pre-charge period in the present embodiment), the first switch signal S1 and the third switch signal S3 have low-voltage levels; the second switch signal S2 and the fourth switch signal S4 have high-voltage levels; and the data signal Vdata has a low-voltage level (that is, there is no data signal Vdata for controlling the light brightness of the light emitting diode D1). Accordingly, the third transistor M3 and the sixth transistor M6 are turned off by being supplied with low-voltage levels through the gate terminals thereof; and the first transistor M1, the fourth transistor M4 and the fifth transistor M5 are turned on by being supplied with high-voltage levels through the gate terminals thereof. Thus, the high voltage OVDD supplied to the first terminal of the first transistor M1 is further transmitted to the node A (FIG. 1) sequentially through the turned-on first transistor M1 and the turned-on fourth transistor M4, thereby charging the node A to have the high voltage OVDD; and the node B (FIG. 1) is charged to the reference voltage Vref through the turned-on fifth transistor M5. In addition, because the sixth transistor M6 is turned off and the reference voltage Vref is configured to be smaller than the low voltage OVSS supplied to the second terminal of the light emitting diode D1, the light emitting diode D1 is turned off due to no current is flowing through the light emitting diode D1.

In the period II (right after the period I and also referred to as a threshold voltage compensation period in the present embodiment), the first switch signal S1 and the fourth switch signal S4 have high-voltage levels; the second switch signal S2 and the third switch signal S3 have low-voltage levels; and the data signal Vdata has a high-voltage level (that is, there exists the data signal Vdata for controlling the light brightness of the light emitting diode D1). Accordingly, the first transistor M1 and the sixth transistor M6 are turned off by being supplied with low-voltage levels through the gate terminals thereof; and the third transistor M3, the fourth transistor M4 and the fifth transistor M5 are turned on by being supplied with high-voltage levels through the gate terminals thereof. Because the first transistor M1 is turned off, the third transistor M3 is turned on and the data signal Vdata is supplied to the first terminal of the third transistor M3, the voltage at the node A is dropped from the high voltage OVDD in the period I to Vdata+Vt; wherein Vt is the threshold voltage of the second transistor M2. In addition, because the voltage at the node A is maintained at Vdata+Vt while the second transistor M2 is turned off resulted from the decreasing of the voltage at the node A, thereby achieving the effect of the compensation of the threshold voltage Vt. Same as in the period I, the node B (FIG. 1) is charged to the reference voltage Vref through the turned-on fifth transistor M5. In addition, because the sixth transistor M6 is turned off and the reference voltage Vref is configured to be smaller than the low voltage OVSS supplied to the second terminal of the light emitting diode D1, the light emitting diode D1 is turned off due to no current is flowing through the light emitting diode D1.

In the period III (right after the period II and also referred to as an emission period in the present embodiment), the first switch signal S1 and the fourth switch signal S4 have low-voltage levels; the second switch signal S2 and the third switch signal S3 have high-voltage levels; and the data signal Vdata has a low-voltage level (that is, there is no data signal Vdata for controlling the light brightness of the light emitting diode D1). Accordingly, the third transistor M3, the fourth transistor M4 and the fifth transistor M5 are turned off by being supplied with low-voltage levels through the gate terminals thereof; and the first transistor M1 and the sixth transistor M6 are turned on by being supplied with high-voltage levels through the gate terminals thereof. Thus, the high voltage OVDD supplied to the first terminal of the first transistor M1 is further transmitted to the light emitting diode D1 sequentially through the turned-on first transistor M1, the turned-on second transistor M2 and the turned-on sixth transistor M6, thereby charging the voltage at the node B (or, the first terminal of the light emitting diode D1) to OVSS+VOLED; wherein VOLED is the driving voltage of the light emitting diode D1. In addition, because the voltage at the node B is OVSS+VOLED, which is larger than the low voltage OVSS supplied to the second terminal of the light emitting diode D1, the light emitting diode D1 is turned on and emits light according to the driving current Ids. In addition, because the characteristic of the capacitor Cst, the voltage at the node A is increased from Vdata+Vt in the period II to Vdata+Vt−Vref+OVSS+VOLED, the crossing voltage Vgs between the gate terminal and the source terminal of the second transistor M2 is obtained by:

$$Vgs=Vg-Vs=(V\text{data}+Vt-V\text{ref}+\text{OVSS}+\text{VOLED})-(\text{OVSS}+\text{VOLED})$$

wherein Vg is the voltage at the gate terminal of the second transistor M2, Vs is the voltage at the source terminal of the second transistor M2. The current Ids flowing from the drain terminal to the source terminal of the second transistor M2 is obtained by:

$$Ids=K(Vgs-Vt)^2=K(V\text{data}+Vt-V\text{ref}-Vt)^2=K(V\text{data}-V\text{ref})^2$$

wherein K is a constant. Thus, it is to be noted that the driving current flowing through the light emitting diode D1 is only related to the data signal Vdata provided in the period II and is unrelated to the threshold voltage Vt of the second transistor M2 as well as the change of the voltage drop of the light emitting diode D1; consequentially, the non-uniformity or other related poor displaying issues in the conventional pixel circuit is avoided.

Figure 3:
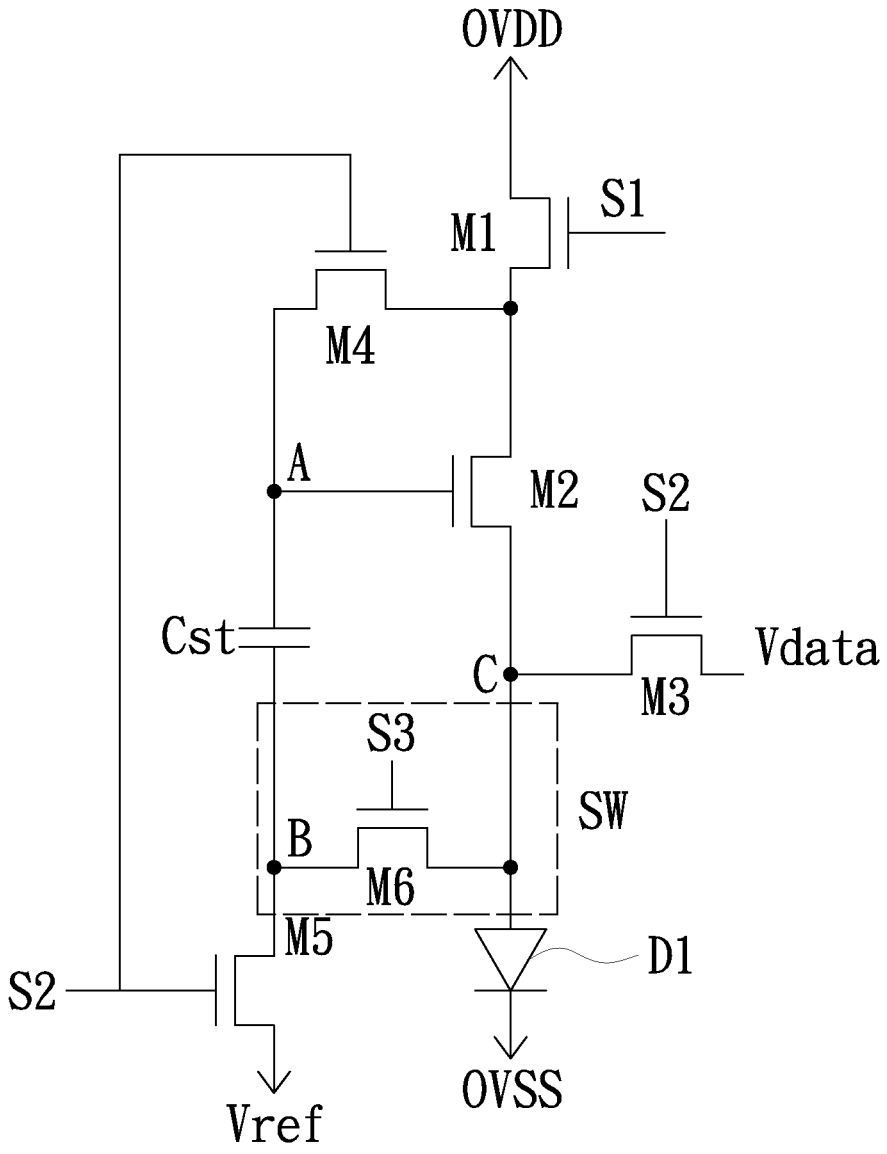
FIG. 3 is a schematic view of a pixel compensation circuit in accordance with a second embodiment of the present disclosure.

FIG. 3 is a schematic view of a pixel compensation circuit in accordance with a second embodiment of the present disclosure. As shown, the pixel compensation circuit in the present embodiment includes a first transistor M1, a second transistor M2, a third transistor M3, a fourth transistor M4, a fifth transistor M5, a switch unit SW, a light emitting diode D1 and a capacitor Cst. In one embodiment, the first transistor M1, the third transistor M3, the fourth transistor M4, the fifth transistor M5 and the switch unit SW are configured to be turned on or turned off according to a received switch signal thereby forming a loop; wherein the aforementioned switch signal may include a first switch signal S1, a second switch signal S2 and a third switch signal S3.

The first transistor M1 is configured to have its gate terminal for receiving the first switch signal S1; its first terminal for receiving a high voltage OVDD; and its second terminal electrically connected to the first terminal of the second transistor M2 and the first terminal of the fourth transistor M4. The second transistor M2 is, for example, a driving transistor and configured to have its gate terminal electrically connected to the second terminal of the fourth transistor M4 and the first terminal of the capacitor Cst; its first terminal electrically connected to the second terminal of the first transistor M1 and the first terminal of the fourth transistor M4; and its second terminal electrically connected to the second terminal of the third transistor M3 and the switch unit SW. The third transistor M3 is configured to have its gate terminal for receiving the second switch signal is S2; its first terminal for receiving a data signal Vdata; and its second terminal electrically connected to the second terminal of the second transistor M2 and the switch unit SW. The aforementioned data signal Vdata is for controlling the light brightness of the light emitting diode D1.

The fourth transistor M4 is configured to have its gate terminal for receiving the second switch signal S2; its first terminal electrically connected to the second terminal of the first transistor M1 and the first terminal of the second transistor M2; and its second terminal electrically connected to the gate terminal of the second transistor M2 and the first terminal of the capacitor Cst. The fifth transistor M5 is configured to have its gate terminal for receiving the second switch signal S2; its first terminal electrically connected to the second terminal of the capacitor Cst and the switch unit SW; and its second terminal for receiving a reference voltage Vref. The light emitting diode D1 is configured to have its first terminal electrically connected the switch unit SW; and its second terminal for receiving a low voltage OVSS. Specifically, the light emitting diode D1 is configured to determine its light brightness according to a driving current flowing from its first terminal to its second terminal (that is, the current Ids flowing from the drain terminal to the source terminal of the second transistor M2).

FIG. 2 is a timing diagram of the switch signal S1, the second switch signal S2, the third switching signal S3 and the data signal Vdata in accordance with the second embodiment of the present disclosure. As shown, the timing diagram is exemplified to have three successive periods I, II and III. As shown, the first switch signal S1 and the data signal Vdata have the opposite timing sequence; that is, the first switch signal S1 has a high-voltage level while the data signal Vdata has a low-voltage level and the first switch signal S1 has a low-voltage level while the data signal Vdata has a high-voltage level. The second switch signal S2 and the third switch signal S3 have the opposite timing sequence; that is, the second switch signal S2 has a high-voltage level while the third switch signal S3 has a low-voltage level and the second switch signal S2 has a low-voltage level while the third switch signal S3 has a high-voltage level.

Figure 4:
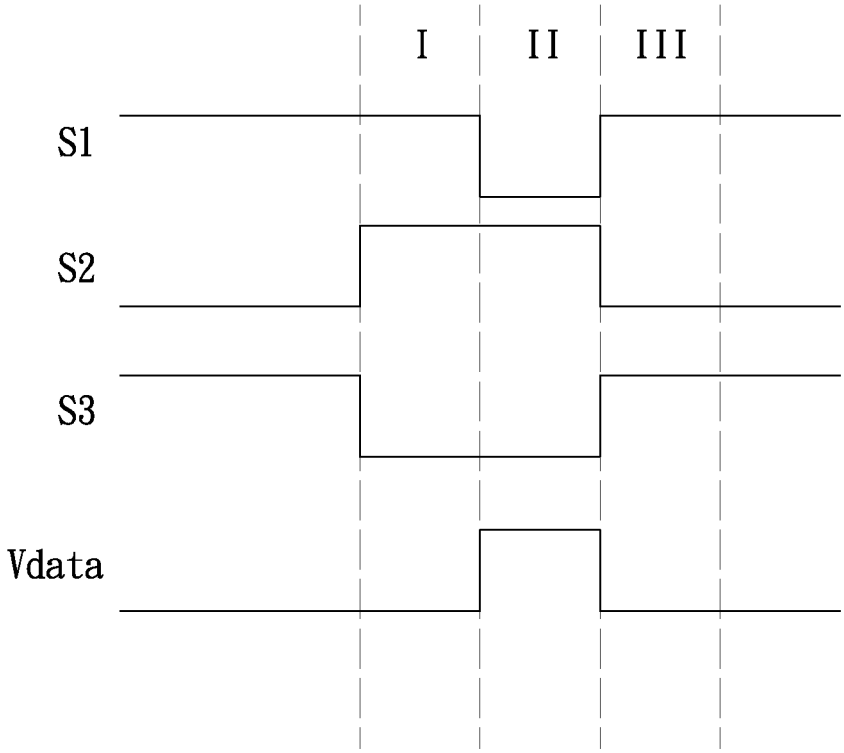
FIG. 4 is a timing diagram of the signals associated with the pixel compensation circuit shown in FIG. 3.

The operation of the pixel compensation circuit in the present embodiment will be described in detail as follow with a reference of FIGS. 3, 4. First, in the period I (also referred to as a pre-charge period in the present embodiment), the third switch signal S3 has a low-voltage level; the first switch signal S1 and second switch signal S2 have high-voltage levels; and the data signal Vdata has a low-voltage level (that is, there is no data signal Vdata for controlling the light brightness of the light emitting diode D1). Accordingly, the sixth transistor M6 is turned off by being supplied with a low-voltage level through the gate terminal thereof; and the first transistor M1, the third transistor M3, the fourth transistor M4 and the fifth transistor M5 are turned on by being supplied with high-voltage levels through the gate terminals thereof. Thus, the high voltage OVDD supplied to the first terminal of the first transistor M1 is further transmitted to the node A (FIG. 3) sequentially through the turned-on first transistor M1 and the turned-on fourth transistor M4, thereby charging the node A to have the high voltage OVDD; and the node B (FIG. 3) is charged to the reference voltage Vref through the turned-on fifth transistor M5. In addition, because the first terminal of the third transistor M3 receives the data signal Vdata, the node C (FIG. 3) is charged to the low-voltage level of the data signal Vdata. In addition, because the current data signal Vdata is smaller than the low voltage OVSS supplied to the second terminal of the light emitting diode D1, the light emitting diode D1 is turned off due to no current is flowing through the light emitting diode D1.

In the period II (right after the period I and also referred to as a threshold voltage compensation period in the present embodiment), the second switch signal S2 has a high-voltage level; the first switch signal S1, the second switch signal S2 and the third switch signal S3 have low-voltage levels; and the data signal Vdata has a high-voltage level (that is, there exists the data signal Vdata for controlling the light brightness of the light emitting diode D1). Accordingly, the first transistor M1 and the sixth transistor M6 are turned off by being supplied with low-voltage levels through the gate terminals thereof; and the third transistor M3, the fourth transistor M4 and the fifth transistor M5 are turned on by being supplied with high-voltage levels through the gate terminals thereof. Because the first transistor M1 is turned off, the third transistor M3 is turned on and the data signal Vdata is supplied to the first terminal of the third transistor M3, the voltage at the node A is dropped from the high voltage OVDD in the period I to Vdata+Vt; wherein Vt is the threshold voltage of the second transistor M2. In addition, because the voltage at the node A is maintained at Vdata+Vt while the second transistor M2 is turned off resulted from the decreasing of the voltage at the node A, thereby achieving the effect of the compensation of the threshold voltage Vt. Same as in the period I, the node B (FIG. 1) is charged to the reference voltage Vref through the turned-on fifth transistor M5. In addition, because the first terminal of the third transistor M3 receives the data signal Vdata, the node C (FIG. 3) is charged to the high-voltage level of the data signal Vdata. In addition, because the current high-voltage-level data signal Vdata is smaller than the low voltage OVSS supplied to the second terminal of the light emitting diode D1, the light emitting diode D1 is turned off due to no current is flowing through the light emitting diode D1.

In the period III (right after the period II and also referred to as an emission period in the present embodiment), the second switch signal S2 has a low-voltage level; the first switch signal S1 and the third switch signal S3 have high-voltage levels; and the data signal Vdata has a low-voltage level (that is, there is no data signal Vdata for controlling the light brightness of the light emitting diode D1). Accordingly, the third transistor M3, the fourth transistor M4 and the fifth transistor M5 are turned off by being supplied with low-voltage levels through the gate terminals thereof; and the first transistor M1 and the sixth transistor M6 are turned on by being supplied with high-voltage levels through the gate terminals thereof. Thus, the high voltage OVDD supplied to the first terminal of the first transistor M1 is further transmitted to the first terminal of the light emitting diode D1 sequentially through the turned-on first transistor M1 and the turned-on second transistor M2, thereby charging the voltage at the node C to OVSS+VOLED; wherein VOLED is the driving voltage of the light emitting diode D1. In addition, because the voltage at the node C is OVSS+VOLED, which is larger than the low voltage OVSS supplied to the second terminal of the light emitting diode D1, the light emitting diode D1 is turned on and emits light according to the driving current Ids. In addition, because the characteristic of the capacitor Cst, the voltage at the node A is increased from Vdata+Vt in the period II to Vdata+Vt-Vref+OVSS+VOLED, the crossing voltage Vgs between the gate terminal and the source terminal of the second transistor M2 is obtained by:

$$Vgs=Vg-Vs=(V\text{data}+Vt-V\text{ref}+\text{OVSS}+\text{VOLED})-(\text{OVSS}+\text{VOLED})$$

wherein Vg is the voltage at the gate terminal of the second transistor M2, Vs is the voltage at the source terminal of the second transistor M2. The current Ids flowing from the drain terminal to the source terminal of the second transistor M2 is obtained by:

$$Ids=K(Vgs-Vt)^2=K(V\text{data}+Vt-V\text{ref}-Vt)^2=K(V\text{data}-V\text{ref})$$

wherein K is a constant. Thus, it is to be noted that the driving current flowing through the light emitting diode D1 is only related to the data signal Vdata provided in the period II and is unrelated to the threshold voltage Vt of the second transistor M2 as well as the change of the voltage drop of the light emitting diode D1; consequentially, the non-uniformity or other related poor displaying issues in the conventional pixel circuit is avoided.

In summary, through employing a switch circuit, the pixel compensation circuit of the present disclosure can automatically and in advance compensate the threshold voltage according to the received switch signal. Consequentially, the driving current flowing through the light emitting diode will not be changed with the voltage drop thereof; and as a result, the non-uniformity or other related poor displaying issues are avoided.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A pixel compensation circuit, comprising:

a first transistor, configured to have a gate terminal thereof for receiving one of a plurality of respective switch signals and a first terminal thereof for receiving a high voltage;

a second transistor, configured to have a first terminal thereof electrically connected to a second terminal of the first transistor;

a third transistor, configured to have a gate terminal thereof for receiving one of the plurality of respective switch signals, a first terminal thereof for receiving a data signal, and a second terminal thereof electrically connected to a second terminal of the second transistor;

a fourth transistor, configured to have a gate terminal thereof for receiving one of the plurality of respective switch signals, a first terminal thereof electrically connected to a second terminal of the first transistor, and the first terminal of the second transistor, and a second terminal thereof electrically connected to the gate terminal of the second transistor and a first terminal of a capacitor;

a fifth transistor, configured to have a gate terminal thereof for receiving one of the plurality of respective switch signals, a first terminal thereof electrically connected to a second terminal of the capacitor, and a second terminal thereof for receiving a reference voltage;

a switch unit, configured to receive one of the plurality of respective switch signals and electrically connected to the second terminal of the third transistor, the first terminal of the fifth transistor, and the second terminal of the capacitor; and a light emitting diode, configured to have a first terminal thereof electrically connected to the switch unit and a second terminal thereof for receiving the low voltage.

2. The pixel compensation circuit according to claim 1, wherein the switch unit comprises:

a sixth transistor, configured to have a gate terminal thereof for receiving one of the plurality of respective switch signals, a first terminal thereof electrically connected to the second terminal of the third transistor, and a second terminal thereof electrically connected to the first terminal of the light emitting diode, the first terminal of the fifth transistor, and the second terminal of the capacitor.

3. The pixel compensation circuit according to claim 2, wherein the plurality of respective switch signals comprises a first switch signal, a second switch signal, a third switch signal and a fourth switch signal.

4. The pixel compensation circuit according to claim 3, wherein the gate terminal of the first transistor is for receiving the second switch signal, the gate terminal of the third transistor is for receiving the first switch signal, the gate terminal of the fourth transistor is for receiving the fourth switch signal, the gate terminal of the fifth transistor is for receiving the fourth switch signal, and the gate terminal of the sixth transistor is for receiving the third switch signal.

5. The pixel compensation circuit according to claim 4, wherein the first switch signal and the data signal have a same timing sequence.

6. The pixel compensation circuit according to claim 4, wherein the first switch signal and the second switch signal have an opposite timing sequence.

7. The pixel compensation circuit according to claim 4, wherein the third switch signal and the fourth switch signal have an opposite timing sequence.

8. The pixel compensation circuit according to claim 1, wherein the switch unit comprises:

a sixth transistor, configured to have a gate terminal thereof for receiving one of the plurality of respective switch signals, a first terminal thereof electrically connected to the second terminal of the third transistor and the first terminal of the light emitting diode, and a second terminal thereof electrically connected to the first terminal of the fifth transistor and the second terminal of the capacitor.

9. The pixel compensation circuit according to claim 8, wherein the plurality of respective switch signals comprises a first switch signal, a second switch signal and a third switch signal.

10. The pixel compensation circuit according to claim 9, wherein the gate terminal of the first transistor is for receiving the first switch signal, the gate terminal of the third transistor is for receiving the second switch signal, the gate terminal of the fourth transistor is for receiving the second switch signal, the gate terminal of the fifth transistor is for receiving the second switch signal, and the gate terminal of the sixth transistor is for receiving the third switch signal.

11. The pixel compensation circuit according to claim 10, wherein the first switch signal and the data signal have an opposite timing sequence.

12. The pixel compensation circuit according to claim 10, wherein the second switch signal and the third switch signal have an opposite timing sequence.

13. The pixel compensation circuit according to claim 11, wherein the data signal is smaller than the low voltage.

* * * * *